US005514225A

United States Patent [19]

Yamada et al.

[11] Patent Number: 5,514,225

[45] Date of Patent: May 7, 1996

[54] CASE NITRIDED ALUMINUM PRODUCT, PROCESS FOR CASE NITRIDING THE SAME, AND NITRIDING AGENT FOR THE SAME

[75] Inventors: Yasuhiro Yamada, Tajimi; Hirohisa Miura, Okazaki; Mamoru Okamoto, Nishikamo; Takashi Matsufuji, Yamatokoriyama; Taro Tatsumi, Gamoh; Kazuo Fujii, Ohmihachiman, all of Japan

[73] Assignees: Toyota Jidosha Kabushiki Kaisha, Aichi; Toyo Aluminum K.K., Osaka, both of Japan

[21] Appl. No.: 317,525

[22] Filed: Oct. 4, 1994

[30] Foreign Application Priority Data

Oct. 5, 1993 [JP] Japan ..... 5-274878
Oct. 4, 1994 [JP] Japan ..... 6-240386

[51] Int. Cl.[6] ..... C23C 8/24

[52] U.S. Cl. ..... 148/238; 148/698; 148/317

[58] Field of Search ..... 148/238, 698, 148/317; 428/472.2

[56] References Cited

U.S. PATENT DOCUMENTS 4,522,660 6/1985 Suzuki ..... 140/20.3

FOREIGN PATENT DOCUMENTS

| | | |
|---|---|---|
| 294289 | 9/1991 | Germany . |
| 4106745 | 9/1992 | Germany . |
| 60-211061 | 10/1985 | Japan . |
| 62-153107 | 7/1987 | Japan . |
| 62-278202 | 12/1987 | Japan . |
| 63-290255 | 11/1988 | Japan . |

OTHER PUBLICATIONS

Scholz, H. & Greil, P., "Nitridation Reactions of Molten Al-(Mg, Si) Alloys," *Journel of Materials Science*, 26 (1991) pp. 669-677.

*Primary Examiner*—Sam Silverberg
*Attorney, Agent, or Firm*—Oliff & Berridge

[57] ABSTRACT

A case nitrided aluminum product is produced by contacting an aluminum product with a nitriding agent at a part of a surface thereof at least, and by nitriding the aluminum product at the surface with an ambient gas at a temperature of a melting point of the aluminum product or less while keeping the aforementioned contact. The nitriding agent includes an aluminum powder, and the ambient gas virtually includes a nitrogen gas. The resulting nitriding layer has a depth of 5 micrometers or more, and it exhibits a case hardness of from 250 to 1,200 mHv. Thus, it is possible to form the deep and hard nitriding layer on the aluminum product with ease under the conditions where it has been said to be too difficult to nitride aluminum products. The case nitrided aluminum product can appropriately make sliding parts which require high wear resistance.

6 Claims, 8 Drawing Sheets

⊢ 100μm

100μm

10μm

100μm

100μm

10μm

100μm

CASE NITRIDED ALUMINUM PRODUCT, PROCESS FOR CASE NITRIDING THE SAME, AND NITRIDING AGENT FOR THE SAME

BACKGROUND OF THE INVENTION

1. Field of the Invention

The present invention relates to a case nitrided product, a process for producing a case nitrided product, and a nitriding agent used for nitriding an aluminum product.

2. Description of the Related Art

Aluminum products have been well known that they exhibit a hardness smaller than that of steel or the like. When they are slid on the steel of the like, they are extremely likely to be seized and worn out. Therefore, they have been investigated for their applicability to a variety of surface treatments which utilize, fop example, plating, thermal spraying, anode oxidizing and the like. Some of the treatments have been put into actual applications. Most of these treatments form an oxide layer on the surface of the aluminum products. There were a few try-outs by nitriding, however, the resulting nitriding layers formed on the surface of the aluminum products were so thin that no satisfactory case nitrided aluminum products have been available so far. Since these trial nitriding processes have required expensive equipment capable of producing a high degree of vacuum or the like, none of the processes have been put into actual application.

As recited in Japanese Unexamined Patent Publication (KOKAI) No. 60-211,061, there has been reported recently a process for forming a nitriding layer on the surface of the aluminum products. According to the process, prior to nitriding step, a pre-sputtering step is carried out in an argon gas atmosphere which contains a nitrogen or oxygen gas in a trace amount, and then a nitriding step is carried out by ion nitriding in which glow discharge is effected in a nitrogen gas atmosphere. Further, as set forth in Japanese Unexamined Patent Publication (KOKAI) No. 63-290,255, there is disclosed a surface treatment process for an aluminum product which utilizes a nitrogen ion injection. Furthermore, in Japanese Unexamined Patent Publication (KOKAI) No. 62-153,107 and Japanese Unexamined Patent Publication (KOKAI) No. 62-278,202, as a direct nitriding process for aluminum, there are disclosed examples of directly nitriding granular aluminum, however, there are no descriptions that the nitriding can be used as a surface treatment.

Aluminum has a melting point of 650° C. The melting point is lower by a factor of about ⅓ than that of steel (e.g., about 1,600° C.). Accordingly, during the surface treatments which are carried out below the melting point either by means of aluminum oxide layer formation or aluminum nitride formation, it has been regarded inevitable that the film forming rate is extremely slow. Further, aluminum is very active and is likely to be oxidized. Consequently, on the surface of aluminum, there always exists a natural oxide layer slightly occupying a part of the area thereof. The oxide layer inhibits the nitriding layer from forming. Furthermore, even if the oxide layer can be removed by sputtering or the like prior to surface treatment, aluminum is oxidized preferentially in commercially available apparatuses which produce a vacuum on the order of $10^{-5}$ Tort vacuum degree. Hence, it has been said that aluminum is hardly nitrided.

SUMMARY OF THE INVENTION

The present invention has been developed in view of the circumstances described above. It is therefore an object of the present invention to provide a case nitrided product which is formed without employing the pre-sputtering, which is formed not by the vacuum apparatus capable of producing the high degree of vacuum but by an ordinary nitriding furnace, and which has a deep and high-hardness nitriding layer formed on the surface. It is a further object of the present invention to provide a nitriding process and a nitriding agent which are capable of producing the case nitrided product.

The present invention is based on a discovery that, when the surface of an aluminum product was covered with an aluminum powder and a heat treatment was carried out onto the aluminum product covered with the aluminum powder in a nitrogen gas atmosphere, a relatively thick nitriding layer was formed on the surface portion of the aluminum product. This discovery was a clue, and it led to a variety of experiments and examinations for completing the present invention.

A case nitrided aluminum product according to the present invention comprises a nitriding layer formed by direct nitriding in which a nitrogen gas is acted onto a surface thereof. The nitriding layer has a depth of 5 micrometers or more, and it exhibits a case hardness of from 250 to 1,200 micro Vickers hardness (hereinafter simply referred to as "mHv"). Preferably, it exhibits a case hardness of from 400 to 800 mHv. The term "aluminum" means aluminum and aluminum alloys. The term "powder" means atomized powder, flake powder, and so on.

The nitriding layer of the present case nitrided aluminum product is formed of a mixed phase including aluminum nitride and aluminum. The aluminum nitride is formed as a needle-like configuration which has an extremely fine diameter of from 5 to 50 nm. When the aluminum nitride is included more therein, the nitriding layer exhibits a higher Vickers hardness. In the nitriding layer, there can exist magnesium oxide in an amount of 0.5% by weight or more. It is considered that the magnesium oxide results from the aluminum oxide which was present on the surface of the aluminum product as the natural oxide layer and which was reduced by magnesium included in a nitriding agent, it can exist in the nitriding layer in the aforementioned amount.

The nitriding layer may include nitrogen in an amount of from 5 to 30% by weight at maximum. This maximum nitrogen content defines the nitriding rate in the nitriding layer. When the maximum nitrogen content is less than 5% by weight, the nitriding layer exhibits a low hardness and is poor in strength. When transforming aluminum into aluminum nitride, the transformation causes expansion by a factor of 26% as compared to the aluminum itself, and the resulting nitriding layers exhibit a thermal expansion coefficient decreased to ¼ or less of the aluminum itself. Hence, when the maximum nitrogen content is more than 30% by weight, the resulting nitriding layers are very brittle unpreferably and they are likely to undesirably come off from the mother material.

When the nitriding layer has a depth of 5 micrometers or more, it is possible to fulfill the purposes of the nitriding layer presence. However, in view of the strength and coming-off resistance, it is preferred that the nitriding layer has a depth of 20 micrometers or more.

The nitriding layer can be formed on all over the surface of the aluminum product, or it can be formed partially on a particular surface thereof. The aluminum product can be an aluminum blank of a plate shape, a rod shape or the like, and it can be formed into a predetermined configuration in advance.

The present case nitrided aluminum product can be produced by a process for producing a case nitrided aluminum product according to the present invention. The present process comprises the steps of:

contacting an aluminum product with a nitriding agent at a part of a surface thereof at least, the nitriding agent including an aluminum powder; and nitriding the aluminum product at the surface with an ambient gas at a temperature of a melting point of the aluminum product or less while keeping the aforementioned contact, the ambient gas virtually including a nitrogen gas.

It has not been clear still what principle governs the present process. However, when nitriding is carried out while flowing a nitrogen gas, there is formed a nitriding layer not only on the portions which ape coated with the aluminum powder working as a nitriding agent but also on the portions which are disposed slightly downstream in the nitrogen gas flow with respect to the coated portions. Hence, it is assumed that nascent nitrogens contribute to the nitriding. For instance, it is believed that, when the aluminum powder is used as the nitriding agent and it is brought into contact with the nitrogen gas at a predetermined temperature, the aluminum powder itself is nitrided, and simultaneously a part of the nitrogen gas is excited to produce the nascent nitrogens. It is thus presumed that the nascent nitrogens are absorbed by the aluminum product to thereby form a nitriding layer.

Concretely described, it is assumed that the nascent nitrogens reduces aluminum oxide on the surface of the aluminum product to be nitrided. As a result, the surface of the aluminum product comes to be pure aluminum, and it becomes easy to be nitrided. In a coating layer of an aluminum powder coated on the surface of the aluminum product, the following reaction occurs:

$$\text{Al (powder)}+N_2=\text{Al N}+N;$$

and aluminum oxide on the surface of the aluminum product is reduced as shown in the following chemical equations:

$$(1/5)\ Al_2O_3+N=(2/5)\text{Al N}+(3/5)\ \text{NO}.$$

The surface of the aluminum product is purified so that it becomes easy to be nitrided. After the surface of the aluminum product is purified, it is assumed that nitrogen is easily absorbed from the surface of the aluminum product, and that a thick nitriding layer is formed.

The aluminum powder employed in the present nitriding process can be used as the present nitriding agent as far as it can be nitrided. However, it is preferable to employ an aluminum powder having a high nitriding capability. Such an aluminum can be one which is quenched and solidified, particularly, it can be one which is quenched and solidified at a cooling rate of $10^{2}$°C./sec. or more, preferably at a cooling rate of from $10^{2}$ to $10^{5}$° C./sec. Further, an aluminum powder which is made from an aluminum alloy including magnesium works very well as the nitriding agent. It is especially preferable to select an aluminum powder including magnesium in an amount of 0.5% by weight or more, further preferably in an amount of from 1 to 20% by weight.

The aluminum powder can be used as the nitriding agent not only in the powdered form which is attained, for example, by atomizing, but also in a foiled form, a granulated form or the like. The foil-formed aluminum powder and the granule-formed aluminum powder can be mixed and used together. In other words, it can be formed by pulverizing foils, ribbons, machined wastes or the like by means of stamping, ball-milling or the like.

For instance, the foil-formed (i.e., flake-like) aluminum powder can be prepared by using a ball mill, an attritor, or the like. If such is the case, it is usually possible to employ higher aliphatic acid, such as oleic acid, stearic acid, isosteraric acid, lauric acid, palmitic acid, myristic acid and the like, for a pulverizing-aiding agent. In addition to the higher aliphatic acid, it is also possible to employ aliphatic amine, aliphatic amide, aliphatic alcohol and the like therefor.

As for an average particle diameter of the aluminum powder operating as the nitriding agent, it is preferred that the aluminum nitride has an average particle diameter of from 3 to 200 micrometers. The aluminum powder can be in a granulated form, a foiled form, or mixtures of these two forms. In view of the reactivity, it is preferred that the aluminum powder has a specific surface area of from 0.1 to 15 $m^2/g$, and it is especially preferred that it has a specific surface area of from 0.4 to 1.0 $m^2/g$. The average particle diameter is measured by using "LASER PARTICLE ANALYZER." The specific surface area is calculated with the BET equation.

Magnesium is a metal which has high affinity with oxygen. It is believed that magnesium diffuses on the aluminum product surface to contribute to the following reaction:

$$Al_2O_3+3Mg+N_2=2\text{Al N}+3\text{MgO}$$

The aluminum product to be nitrided can be made either from pure aluminum or aluminum alloys. However, in the aluminum product, depending on the elements excepting the aluminum elements, a variety of nitriding layers can be formed. Magnesium present in the aluminum product functions to thicken the resulting nitriding layers. On the contrary, silicon does not function to thicken the resulting nitriding layers, but it inhibits them from thickening. It is assumed that the other elements usually included in the aluminum product somewhat affect the thickening of the resulting nitriding layers. However, their functions are not verified at present.

The nitriding agent can be a mixture of the aluminum powder and a viscosifying agent. If such is the case, it is preferred that the nitriding agent includes the aluminum powder in an amount of from 5 to 70% by weight and the viscosifying agent in an amount of from 1 to 30% by weight. Since this nitriding agent is used to coat a surface of the aluminum product to be nitrided, it is possible to further mix an additive, such as a solvent or the like, which is usually employed by paint in order to give the paint an appropriate flowing ability. As for the solvent, it is preferable to employ an organic substance which decomposes or vaporizes at a nitriding reaction temperature or less. In addition, when an organic substance produces residual products which are harmless to the nitriding reaction, it is possible to employ such an organic substance as the solvent.

As for the viscosifying agent, it is possible to employ an organic polymer compound, such as polybutene, polyvinyl butyral, polycaprolactone and the like, which decomposes at the nitriding temperature, e.g., usually at a temperature of from 400° to 600° C. It is preferable that the viscosifying agent decomposes during a nitriding treatment. When the viscosifying agent decomposes, an aluminum powder usually cannot be scattered and can be held on the surface of the aluminum product under the condition that a part of the aluminum powder is sintered.

The aluminum product surface and the aluminum powder can be brought into contact with each other by burying the aluminum product in the aluminum powder, or by coating the aluminum product surface with the aluminum powder. In addition, the aluminum product surface can be coated with the above-described paste-like or paint-like nitriding agent. When coating, it is preferred that the nitriding agent is coated as a paint film of from 5 to 1,000 micrometers in thickness. As for the way of coating, it is possible to employ brush-coating, dipping, spray-coating, roller-coating or the like.

Regarding the ambient gas for carrying out the nitriding, a nitrogen gas can be used. It is preferred that the nitrogen gas has less water and oxygen gas contents. The mingling of the inert gas such as an argon gas or the like does not adversely affect the nitriding. Concerning the water content and the oxygen gas content, it is preferred that the nitrogen gas includes water in an amount of 0.1% by volume or less as water vapor and oxygen in an amount of 0.08% by volume or less.

Regarding the nitriding temperature, it is preferred that, in view of the reactivity, the nitriding is carried out at temperatures as high as possible. However, it is necessary that the aluminum product be treated virtually in the solid-phase state. When a deep nitriding layer is not desired, or when the strain resulting from the heat treatment should be reduced, it is preferred that the nitriding is carried out at low temperatures. In view of these requirements, it is usually preferred to carry out the nitriding at a temperature of about 400° to 600° C. for about 2 to 10 hours.

In the present nitriding process, the aluminum product is coated with the nitriding agent which is likely to be nitrided, and it is nitrided in the solid-phase state in the nitrogen atmosphere. First of all, the magnesium included in the nitriding agent reacts with the oxygen of the aluminum oxide included in the nitriding agent. Then, the nitriding agent which is likely to be nitrided is nitrided, thereby producing a formation energy of 300 kJ/mole and the nascent nitrogens. The aluminum product is activated and nitrided by the formation energy and the nascent nitrogens where it is brought into contact with the nitriding agent. Thus, it is possible to form a deep nitriding layer with ease under the conditions where it has been said to be too difficult to carry out nitriding. Therefore, it is possible to easily produce a case nitrided aluminum product whose nitriding layer is enhanced in terms of hardness.

As for the nitriding agent, it is possible to employ an aluminum powder which includes aluminum as a major component. When the nitriding agent is used to partially coat the aluminum product surface or when it is used to partially bury the aluminum product, it enables to nitride the coated or buried portion only. Thus, it is possible to nitride a predetermined portion of the aluminum product only.

In accordance with the present nitriding process using the present nitriding agent, it is possible to produce the present case nitrided aluminum product which comprises the nitriding layer having the depth of 5 micrometers or more and exhibiting the case hardness of from 250 to 1,200 mHv.

As having been described so far, the present case nitrided aluminum product comprises the remarkably deep and hard case nitriding layer. The nitriding layer is formed by heat treating the aluminum product surface by means of the nitrogen gas while the present nitriding agent comprising the aluminum powder is brought into contact with the aluminum product surface. Therefore, the present case nitrided aluminum product can be appropriately applied to sliding parts which require high wear resistance.

In accordance with the present process, the aluminum product can be nitrided with ease where it is brought into contact with the present nitriding agent. On the other hand, it is not nitrided where it is not brought into contact with the present nitriding agent. By utilizing these phenomena, it is possible to only nitride a predetermined portion of the aluminum product where the nitriding is required.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
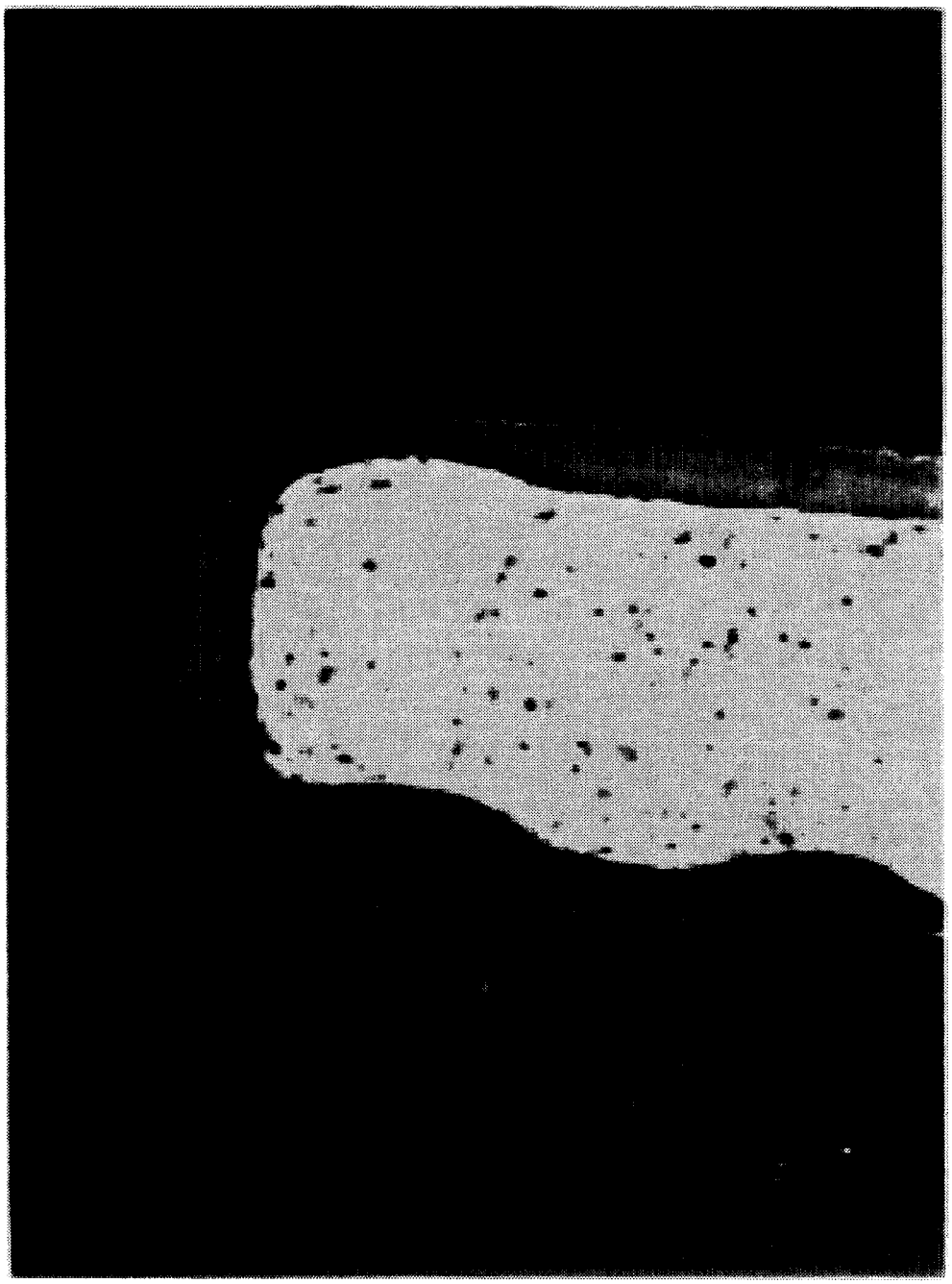
FIG. 1 is a microscope photograph for showing a metallic structure of a case nitrided aluminum product with a nitriding layer formed in accordance with a First Preferred Embodiment of the present invention in cross-section.

Having generally described the present invention, a further understanding can be obtained by reference to the specific preferred embodiments which are provided herein for purposes of illustration only and are not intended to limit the scope of the appended claims.

First Preferred Embodiment

An aluminum alloy having the composition as per JIS (Japanese Industrial Standard) 5052 was melted. The aluminum alloy included Mg in an amount of from 2.2 to 2.8% by weight, Si and Fe in a summed amount of 0.65% by weight or less, Cu in an amount of 0.10% by weight or less, Mn in an amount of 0.10% by weight or less, Zn in an amount of 0.10% by weight or less, Cr in an amount of from 0.15 to 0.35% by weight, and the balance of Al. The resulting molten metal was quenched and solidified by air-atomizing at a cooling rate of $10^{2\circ}$ C./sec. or more, and it was formed into a powdered form having an average particle diameter of from 5 to 200 micrometers.

The resulting aluminum powder was employed as the present nitriding agent, and a pure aluminum plate was employed as the aluminum product to be nitrided. The plate was made from a pure aluminum as per JIS 1100 and had a thickness of 1.0 mm. The aluminum product to be nitrided was buried in the nitriding agent. Then, it was subjected to a nitriding treatment at 540° C. for 10 hours. The nitriding treatment was carried out under the following conditions: A pure nitrogen gas containing 99.9% $N_2$ was introduced into an furnace at a flow of 20 liters/min., and a dew point was held in a range of from −39 to −28° C. in the furnace.

This nitriding treatment produced a nitriding layer on all over the aluminum product surface. In order to examine the resulting nitriding layer, the thus nitrided aluminum product was cut at its end, and it was observed with a microscope for its metallic structure in the cross-section. A microscope photograph thus obtained is shown in FIG. 1. Further, the cross-section of the aluminum product was subjected to an EPMA in order to examine the nitriding layer for its composition by its elements, and the resulting EPMA chart is shown in FIG. 2.

As can be seen from FIG. 1, the depth of the nitriding layer fluctuated, however, it fell in a range of from 70 to 220 micrometers. The hardness of the nitriding layer was 800 mHv under a load of 100 g.

Figure 2:
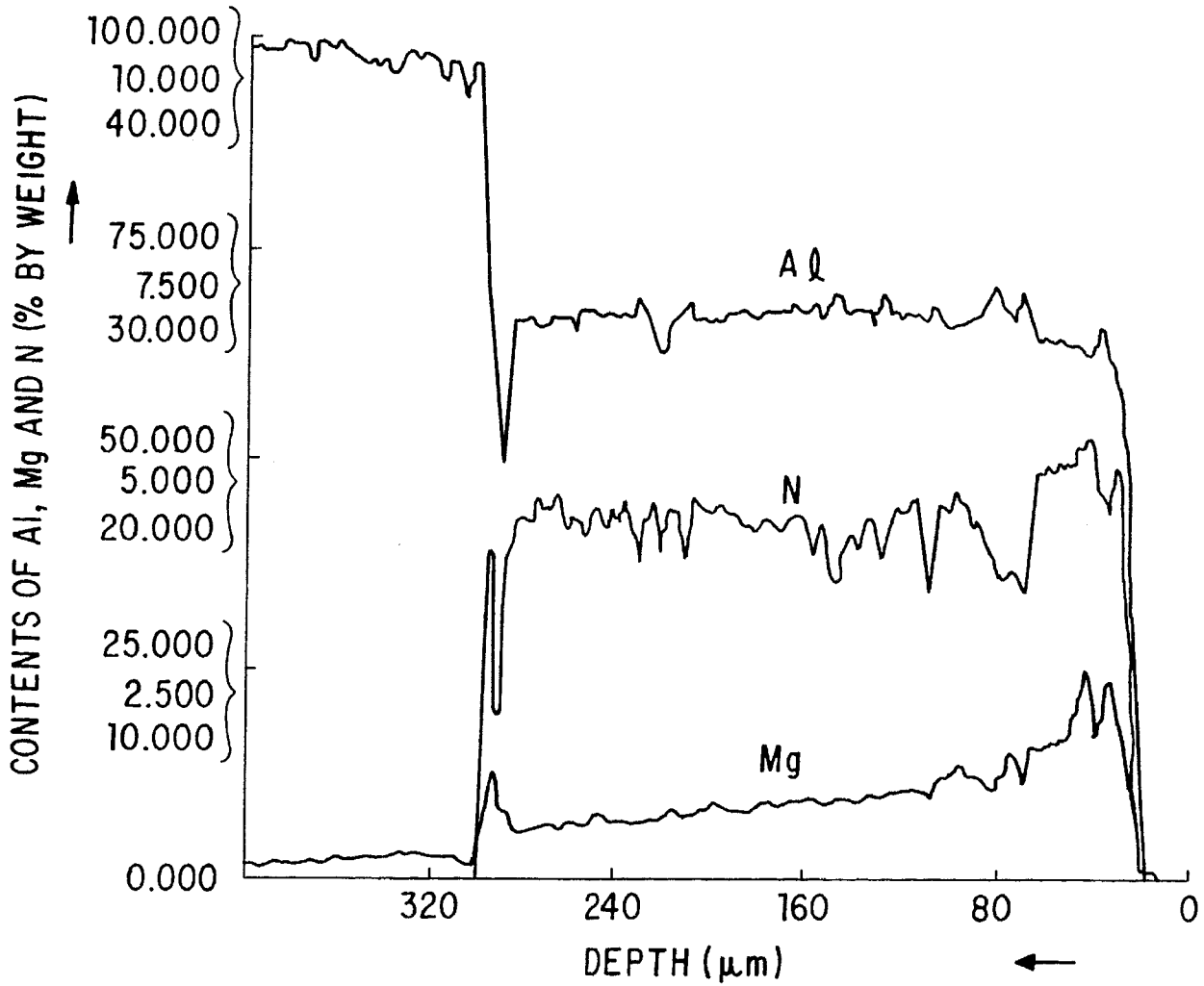
FIG. 2 is a chart for illustrating results of an EPMA (i.e., Electron Probe Microanalysis) to which the case nitrided aluminum product with a nitriding layer formed in accordance with the First Preferred Embodiment was subjected.

As can be understood from FIG. 2 illustrating the results of the elementary analysis, the nitriding layer was found to be comprised of aluminum, nitrogen and magnesium. In FIG. 2, the axis of ordinate expresses the weight percentages of aluminum, magnesium and nitrogen. For example, the values at the uppermost point in the axis of ordinate, e.g., 100.000, 10.000 and 40.000, mean 100% by weight aluminum, 10% by weight magnesium and 40% by weight nitrogen, respectively. The axis of abscissa expresses the depth from the surface. For instance, the right end of the axis of abscissa means the outermost surface, and the nitriding layer becomes deeper as the value goes along the axis of abscissa in the left direction. According to FIG. 2, the nitriding layer had a depth of about 300 micrometers at the analyzed cut end. At this end, the nitriding layer was comprised of aluminum in an amount of about 65% by weight, magnesium in an amount of about 2.5% by weight and nitrogen in an amount of about 20% by weight, and its maximum nitrogen content was 20.90% by weight. The nitrogen content was substantially constant over the entire nitriding layer. On the other hand, the magnesium content was high adjacent to the outermost surface of the nitriding layer, but it decreased gradually as the nitriding layer was formed deeper. However, the magnesium content in the nitriding layer was much higher than the magnesium content in the matrix of the aluminum product. The magnesium in the nitriding layer resulted from the magnesium which diffused from the nitriding agent to the nitriding layer.

Second Preferred Embodiment

In the same manner as set forth in the First Preferred Embodiment, the aluminum alloy powder having the composition as per JIS 5052 was made by quenching and solidifying and employed as the present nitriding agent. As an aluminum product, an aluminum alloy plate having a thickness of 1.50 mm was made from an aluminum alloy. The aluminum alloy had the composition as per JIS 5052. The aluminum alloy plate was also buried in the nitriding agent. Then, it was subjected to two kinds of nitriding treatments, for instance, at 540° C. for 4 hours and at 540° C. for 10 hours. In both of the nitriding treatments, a pure nitrogen gas containing 99.9% $N_2$ was introduced into an furnace at a flow of 30 liters/min. as the nitriding gas, and a dew point was held in a range of from −40° to −25° C. in the furnace.

Figure 3:
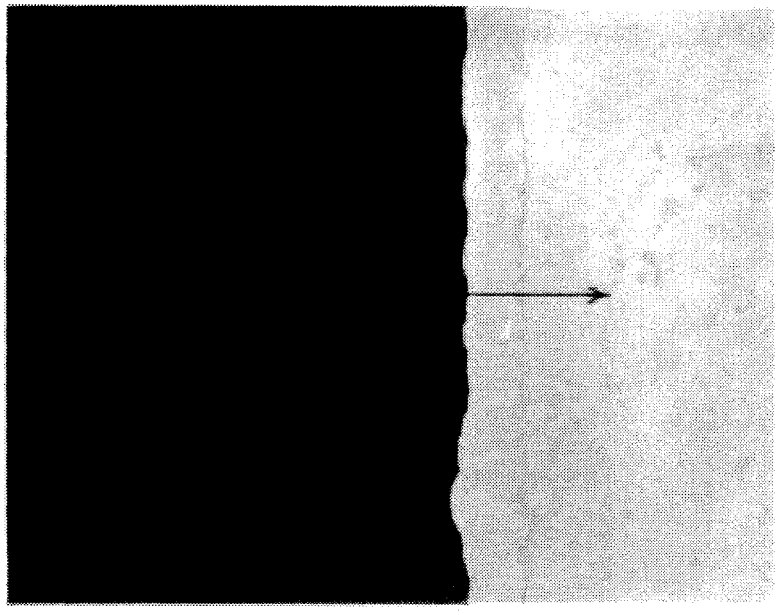
FIG. 3 is a microscope photograph for showing a metallic structure of a case nitrided aluminum product which was nitrided for 4 hours in accordance with a Second Preferred Embodiment of the present invention.
Figure 4:
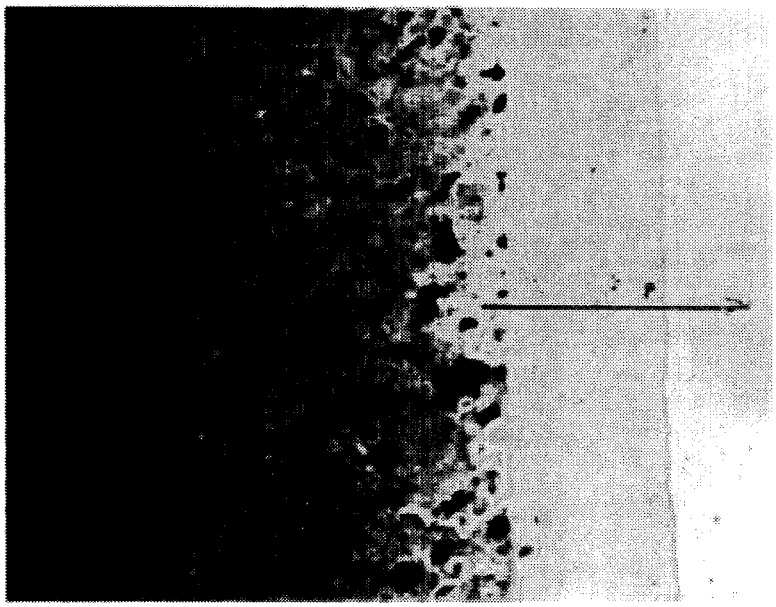
FIG. 4 is a microscope photograph for showing a metallic structure of another case nitrided aluminum product which was nitrided for 10 hours in accordance with the Second Preferred Embodiment.

These two nitriding treatments produced a thick nitriding layer on the surface of the aluminum product. The resulting nitriding layers were similarly observed with a microscope for their metallic structure. FIG. 3 shows a microscope photograph of the case nitrided aluminum product which went through the 4-hour nitriding. FIG. 4 shows a microscope photograph of the case nitrided aluminum product which went through the 10-hour nitriding. In FIGS. 3 and 4, the portion on the right-hand side in the photograph is a metallic structure of the aluminum product matrix, and the gray portion at the middle in the photograph is a metallic structure of the nitriding layer. In the case nitrided aluminum product shown in FIG. 3 which went through the 4-hour nitriding, the nitriding layer had a depth of about 14 micrometers, and it exhibited a hardness of 515 mHv under a load of 100 g. In the case nitrided aluminum product shown in FIG. 4 which went through the 10-hour nitriding, the nitriding layer had a depth of about 130 micrometers, and it exhibited a hardness of 420 mHv under a load of 100 g.

Figure 5:
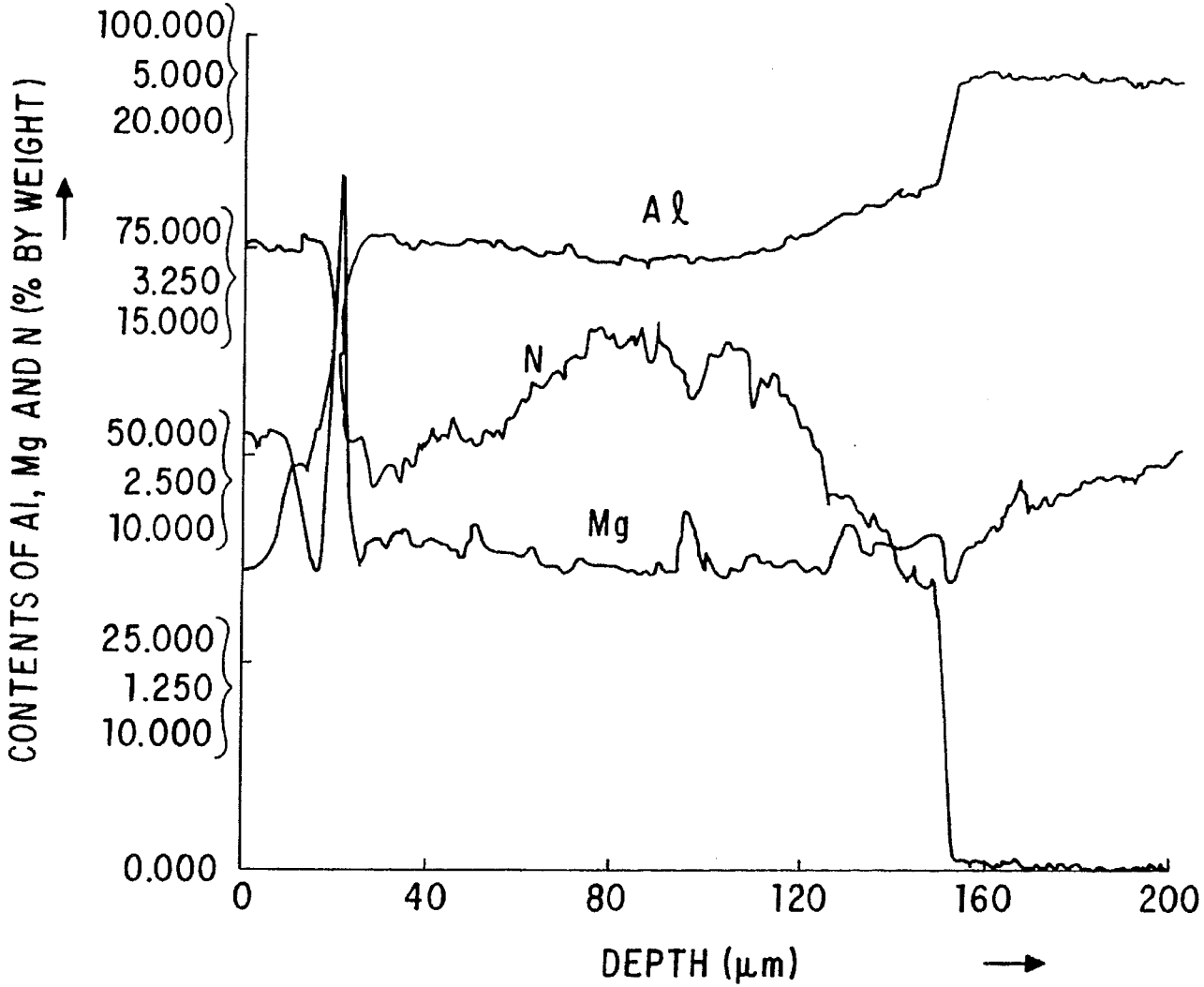
FIG. 5 is a chart for illustrating results of an EPMA to which the case nitrided aluminum product undergone the 10-hour nitriding in accordance with the Second Preferred Embodiment was subjected.
Figure 6:
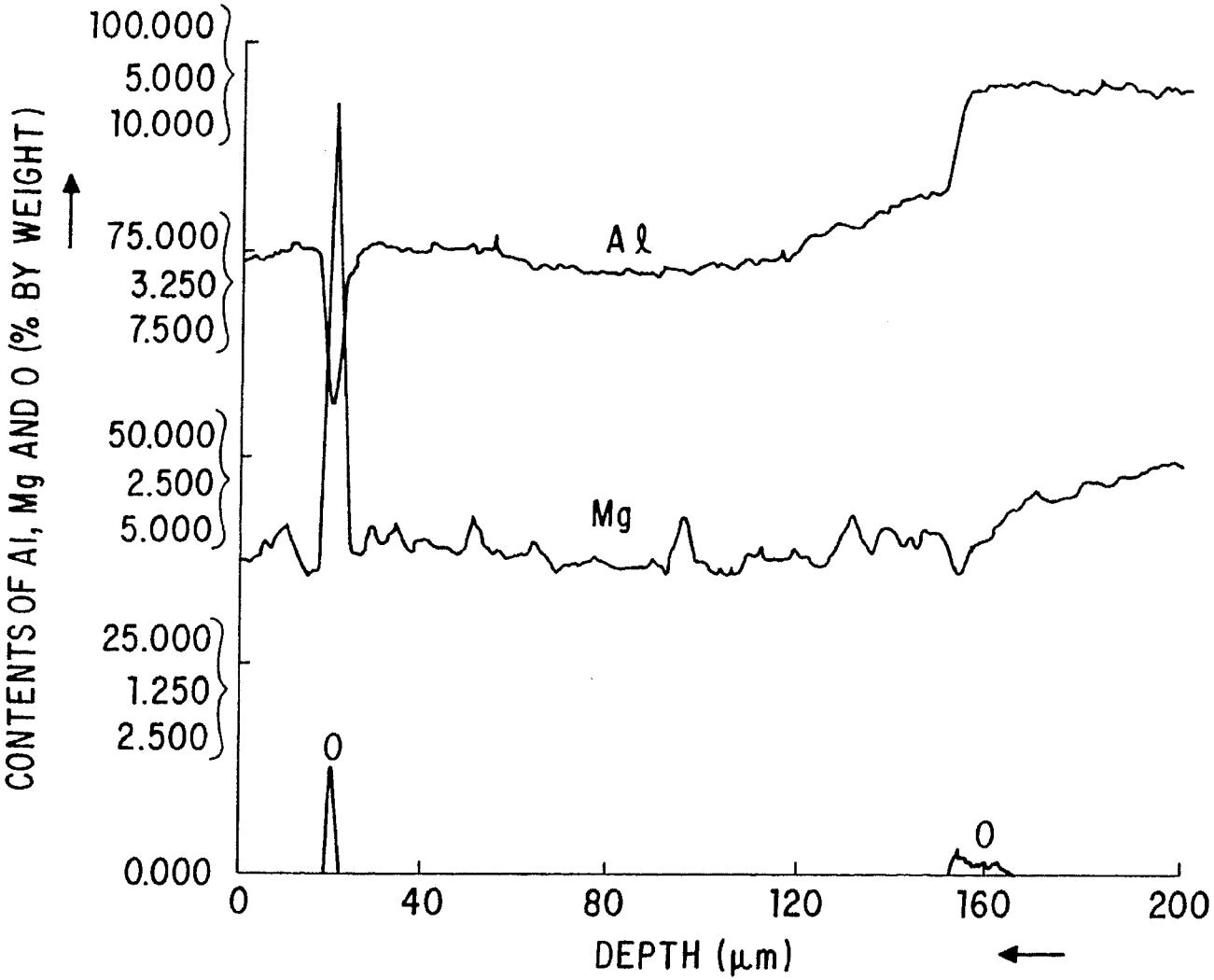
FIG. 6 is a chart for illustrating results of an EPMA in which the case nitrided aluminum product undergone the 10-hour nitriding in accordance with the Second Preferred Embodiment was examined for its oxygen content instead of its nitrogen content illustrated in FIG. 5.

In addition, an elementary analysis was carried out onto the portions of the aluminum product shown in FIG. 4 along the arrow thereof by means of the EPMA. FIGS. 5 and 6 illustrate the results of the elementary analysis. In FIG. 5, similarly to FIG. 2, the axis of ordinate expresses the weight percentages of aluminum, magnesium and nitrogen, and the axis of abscissa expresses the depth from the surface. In FIG. 5, contrary to FIG. 2, the left end of the axis of abscissa means the outermost surface, and the elementary analysis is performed deep inside the aluminum product as the value goes along the axis of abscissa in the right direction. According to FIG. 5, the surface of the case nitrided aluminum product lay at a depth of 20 micrometers, the nitriding agent layer lay in a depth of from 0 to 20 micrometers, the nitriding layer lay in a depth of from 20 to 150 micrometers, and the aluminum matrix of the case nitrided aluminum product lay in a depth of more than 150 micrometers. FIG. 6 illustrates the results of the elementary analysis in which, instead of the nitrogen content illustrated in FIG. 5, the portions of the aluminum product shown in FIG. 4 were examined for the oxygen content along the arrow of FIG. 4.

According to the results of these elementary analyses, the nitriding layer was comprised of nitrogen in an amount of 13.1% by weight in its middle and in an amount of 8.33% by weight at the interface between itself and the aluminum matrix or the aluminum product. It is characteristic in the chart shown in FIGS. 5 and 6 that the magnesium content exhibited a peak at the outermost surface of the case nitrided aluminum product (e.g., the interface between the nitriding agent and the nitriding layer), and that the oxygen content exhibited peaks at the outermost surface and the innermost surface of the nitriding layer. According to the results of the elementary analysis on the oxygen content shown in FIG. 6, the oxygen content was as high as 1.3% by weight at the outermost surface of the nitriding layer. Accordingly, it is believed that there existed oxygen and magnesium in the form of MgO in an amount of 3.3% by weight. Thus, the present inventors came to assume as follows. The oxygen is originally included in the aluminum oxide layer which exists on the outermost surface of the aluminum product, it is then reacted with the magnesium which is moved from the inside of the aluminum product or from the nitriding agent by means of diffusion, and consequently the magnesium oxide is produced.

Third Preferred Embodiment

Two molten aluminums including magnesium in an amount of 2.5% by weight and 5% by weight respectively were quenched and solidified at a cooling rate of $10^{2\circ}$ C./sec. or more. Thus, two aluminum powders were prepared, and they had an average particle diameter of from 3 to 150 micrometers. These two aluminum powders were employed as the present nitriding agent. Further, these two powders were pulverized to foiled-shapes by a ball mill to produce two foil-shaped aluminum powders having a specific surface area of 4 $m^2$/g. These two foil-shaped aluminum powders were also employed as the present nitriding agent. Thus, four nitriding agents according to the present invention were prepared in total.

These four nitriding agents were respectively compounded with polybutene so that they could form a paste-like substance capable of being coated with a brush. The resulting four paste-like nitriding agents were used to coat a variety of aluminum plates and aluminum automotive component parts which were prepared as the aluminum product to be nitrided, and they were coated with a brush so as to form a coating layer of about 10 micrometers in thickness on the aluminum products. Whilst there was prepared a heat treatment furnace whose inner atmosphere was replaced by a nitrogen gas in advance, the aluminum products coated with the four nitriding agents were put into the furnace. Then, the temperature of the furnace was raised in order to carry out a nitriding treatment at 450° C. for 4 hours. In addition, another aluminum products similarly coated with the four nitriding agents were put into the furnace, and they were nitrided at 450° C. for 10 hours. In both of the nitriding treatments, a pure nitrogen gas containing 99.9% $N_2$ was introduced into the furnace at a flow of 10 liters/min., and a dew point was held in a range of From −45° to −25° C. in the furnace.

Figure 7:
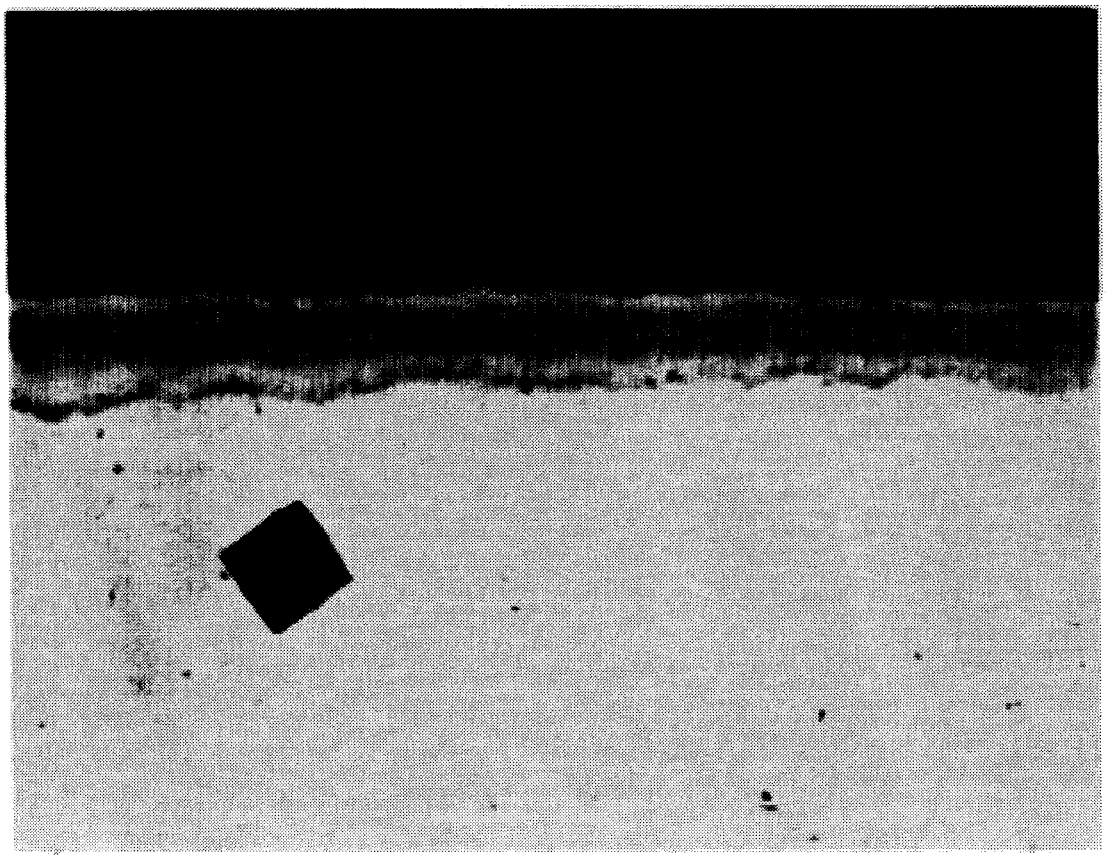
FIG. 7 is a microscope photograph for showing a metallic structure of a case nitrided aluminum product with a nitriding layer formed in accordance with a Third Preferred Embodiment of the present invention in cross-section.

There was produced a thick nitriding layer on the portion of all of the aluminum products where the nitriding agents were coated. For example, FIG. 7 shows an enlarged cross-sectional photograph of the metallic structure of one of the nitriding layers formed on one of the aluminum products, e.g., the aluminum plate, which was made from an aluminum alloy having the composition as per JIS 2024 and which was coated with the paste-like nitriding agent including magnesium in an amount of 5% by weight. The aluminum alloy as per JIS 2024 was comprised of Mg in an amount of from 1.2 to 1.8% by weight, Si in an amount of 0.5% by weight or less, Fe in an amount of 0.5% by weight or less, Cu in an amount of from 3.8 to 4.9% by weight, Mn in an amount of from 0.30 to 0.9% by weight, Zn in an amount of 0.25% by weight or less, Cr in an amount of 0.10% by weight or less, and the balance of Al.

Figure 8:
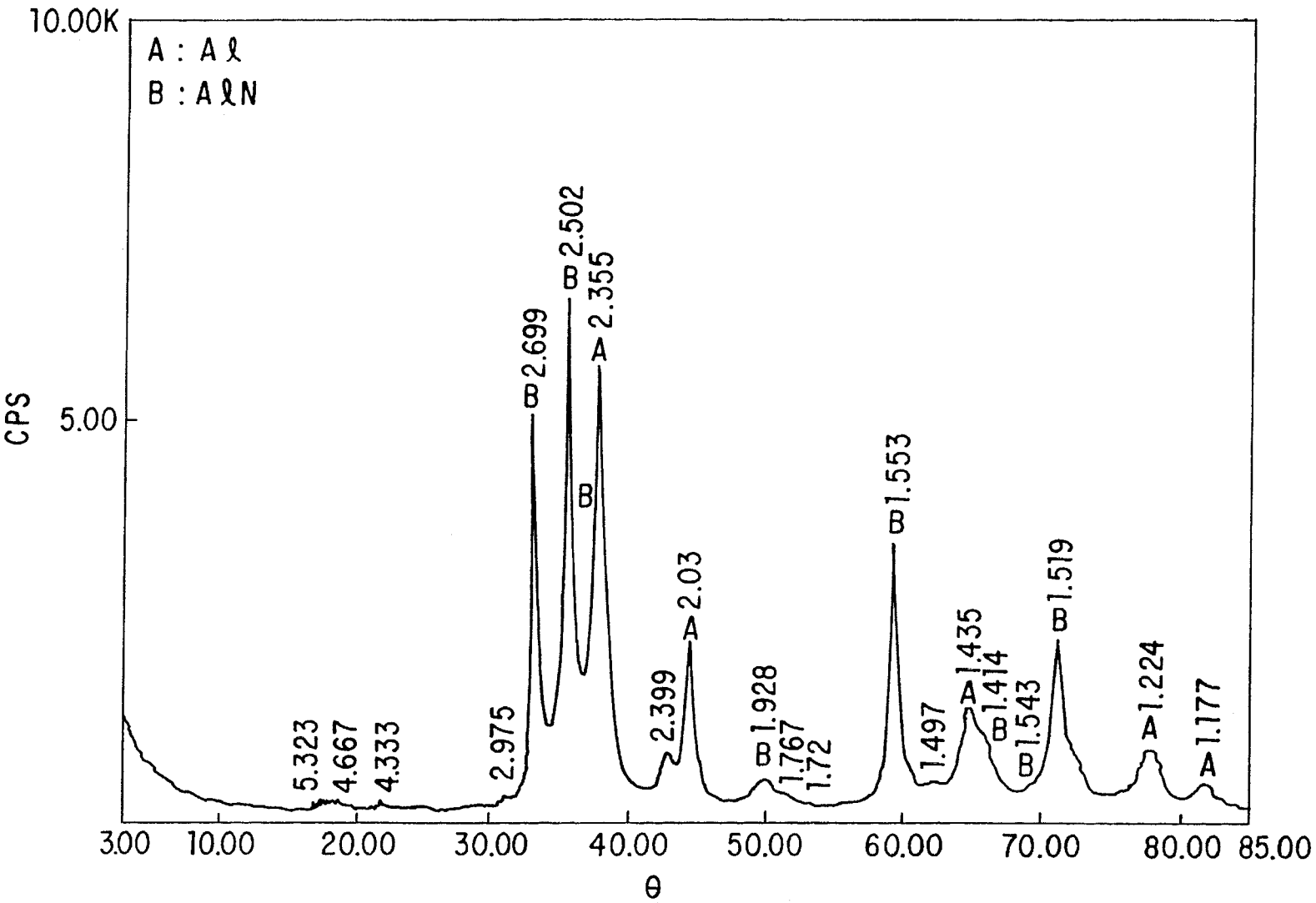
FIG. 8 is a chart for illustrating results of an X-ray diffraction analysis to which the nitriding layer of the case nitrided aluminum product formed in accordance with the Third Preferred Embodiment was subjected.

As can be appreciated from FIG. 7, there was formed the blackish gray nitriding layer having a depth of about 35 micrometers on the aluminum product. In FIG. 7, squares can be seen on the left side of the drawing, and they were dents which were made by pressing during the Vickers hardness measurement. The hardness of the nitriding layer was 440 mHv under a load of 100 g. In addition, FIG. 8 is a chart for illustrating the results of an X-ray diffraction analysis to which this nitriding layer was subjected. According to FIG. 8, this nitriding layer was found to be comprised of a mixed phase including aluminum and aluminum nitride.

Fourth Preferred Embodiment

In the same manner as set forth in the First Preferred Embodiment, an aluminum alloy powder having a composition of 2.5% by weight of Mg and the balance of Al was made by quenching and solidifying, and it was employed as the present nitriding agent. In the resulting aluminum alloy powder, there was buried an aluminum product having a thickness of 5 mm and the composition as per JIS AC4C. Then, it was subjected to a nitriding treatment at 560° C. for 10 hours. In the nitriding treatment, a pure nitrogen gas containing 99.9% $N_2$ was introduced into an furnace at a flow of 30 liters/min., and a dew point was held in a range of from −40° to −25° C. in the furnace.

Figure 9:
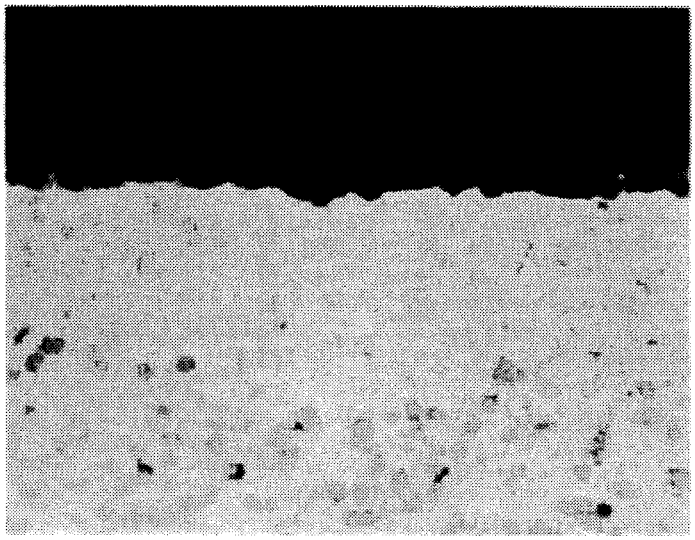
FIG. 9 a microscope photograph for showing a metallic structure of a case nitrided aluminum product with a nitriding layer formed in accordance with a Fourth Preferred Embodiment of the present invention in cross-section.

This nitriding treatment produced a nitriding layer having a depth of about 5 micrometers on all over the surface of the aluminum product. FIG. 9 shows a microscope photograph of the metallic structure of the resulting nitriding layer. In FIG. 9, the aluminum product is the white portion disposed on the lower side of the drawing, the nitriding layer is the light blackish portion disposed on the white portion, and the space is the black portion disposed further on the light blackish portion.

Fifth Preferred Embodiment

A pure molten aluminum including aluminum in an amount of 99.3% by weight was quenched and solidified at a cooling rate of $10^{2\circ}$ C./sec. or more. Thus, an aluminum powder was prepared, and it had an average particle diameter of from 3 to 150 micrometers. Further, this aluminum powder was pulverized to foiled-shapes by a ball mill to produce a foil-shaped aluminum powder having a specific surface area of 5 $m^2$/g. The foil-shaped aluminum powder was employed as the present nitriding agent, and it was compounded with polybutene so that it could form a paste-like substance capable of being coated with a brush.

An aluminum plate having the composition as per JIS 2024 was employed as the aluminum product to be nitrided. The nitriding agent was coated on the aluminum product with a brush so as to form a coating layer of about 20 micrometers in thickness. The thus treated specimens were put into an furnace whose inner atmosphere had been replaced by a nitrogen gas in advance. Then, the temperature of the furnace was raised in order to carry out a nitriding treatment at 540° C. for 10 hours. In the nitriding treatment, a pure nitrogen gas containing 99.9% $N_2$ was introduced into the furnace at a flow of 10 liters/min., and a dew point was held in a range of from −30° to −20° C. in the furnace.

Figure 10:
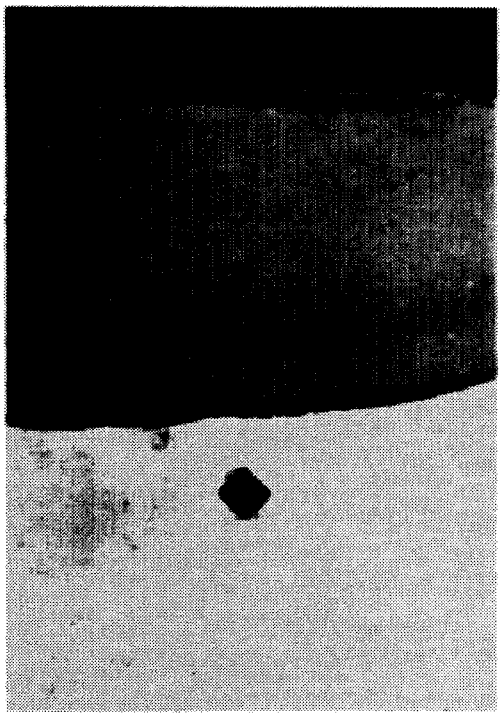
FIG. 10 is a microscope photograph for showing a metallic structure of a case nitrided aluminum product with a nitriding layer formed in accordance with a Fifth Preferred Embodiment of the present invention in cross-section.

There was produced a thick nitriding layer on all over the surface of the aluminum plate. FIG. 10 shows an enlarged cross-sectional photograph of the metallic structure of the resulting nitriding layer. As can be appreciated from FIG. 10, there was formed the blackish gray nitriding layer having a depth of about 350 micrometers on the aluminum product. According to the Vickers hardness measurement, the hardness of the nitriding layer was 274 mHv under a load of 100 g.

Sixth Preferred Embodiment

A molten aluminum alloy including magnesium in an amount of 5% by weight was quenched and solidified at a cooling rate of $10^{2\circ}$ C./sec. or more, thereby producing an atomized powder of an average particle diameter of from 3 to 150 micrometers.

130 grams of the atomized powder was weighed in a beaker having a capacity of 1 liter. 20 grams of a polybutene resin and 30 grams of a solvent were added to the beaker. The polybutene resin was "POLYBUTENE OH" made by IDEMITSU SEKIYU KAGAKU Co., Ltd., and it had a weight average molecular weight of 350 and a viscosity of 22 cSt at 40° C. The solvent was "IP SOLVENT 1620" made by IDEMITSU SEKIYU KAGAKU Co., Ltd. The resulting mixture was stirred at a rate of 1,000 rpm, thereby dispersing the aluminum powder in the resin and the solvent. Thereafter, 20 grams of another polybutene was further added to the beaker gradually while stirring at a rate of 3,000 rpm for 1 hour, thereby producing a paste-like nitriding agent in which the aluminum powder was dispresed uniformly in the resins and the solvent. The other polybutene resin was "POLYBUTENE 300H" made by IDEMITSU SEKIYU KAGAKU Co., Ltd., and it had a weight average molecular weight of 1,500 and a viscosity of 32,000 cSt at 40° C.

Whilst an aluminum product to be nitrided was prepared, a pure aluminum according to JIS 1101 was employed and was processed into a plate having a thickness of 1.0 mm. On the aluminum product, the paste-like nitriding agent was coated.

The thus coated aluminum product was placed in a heat treatment furnace, and it was nitrided at 550° C. for 5 hours under the following conditions: A pure nitrogen gas containing 99.9% $N_2$ was introduced into the furnace at a flow of 20 liters/min., and a dew point was held in a range of from −39° to −28° C. in the furnace.

There was produced a nitriding layer all over the surface of the aluminum product. The nitriding layer had a depth of about 120 micrometers, and it exhibited a hardness of 600 mHv under a load of 100 g.

Seventh Preferred Embodiment

80% by weight of the atomized powder, produced in the same manner as described in the "Sixth Preferred Embodiment" section, was mixed with 20% by weight of oleic acid working as a pulverizing-aiding agent, and it was further pulverized with a ball mill, thereby preparing a flake-formed (or foil-formed) aluminum powder. The foil-formed aluminum powder had a specific surface area of 2.9 $m^2/g$ and an average particle diameter of 36 micrometers.

60 grams of the foil-formed aluminum powder containing oleic acid was weighed in a beaker having a capacity of 1 liter. 8 grams of a polybutene resin and 40 grams of a solvent were added to the beaker. The polybutene resin was "POLYBUTENE OH" made by IDEMITSU SEKIYU KAGAKU Co., Ltd., and the solvent was "IP SOLVENT 1620" made by IDEMITSU SEKIYU KAGAKU Co., Ltd. The resulting mixture was stirred at a rate of 1,000 rpm, thereby dispersing the aluminum powder in the resin and the solvent. Thereafter, 8 grams of another polybutene and 69 grams of another solvent were further added to the beaker while stirring at a rate of 1,000 rpm for 1 hour, thereby producing a nitriding agent. The other polybutene resin was "POLYBUTENE 300H" made by IDEMITSU SEKIYU KAGAKU Co., Ltd., and the other solvent was "BDG" (i.e., polydiglcol) made by NIPPON NYUKAZAI Co., Ltd.

Whilst an aluminum product to be nitrided was prepared, an aluminum alloy according to JIS 2024 was employed and was processed into a plate having a thickness of 1.5 mm. On the aluminum product, the paste-like nitriding agent was coated.

The thus coated aluminum product was placed in a heat treatment furnace, and it was subjected to a nitriding treatment at 500° C. for 10 hours under the following conditions: A pure nitrogen gas containing 99.9% $N_2$ was introduced into the furnace at a flow of 30 liters/min., and a dew point was held in a range of from −40° to −25° C. in the furnace.

There was produced a nitriding layer on the surface of the aluminum products. The nitriding layer had a depth of about 70 micrometers, and it exhibited a hardness of 500 mHv under a load of 100 g.

Eighth Preferred Embodiment

An aluminum flake was weighed so as to place 60 grams of its metallic components in a beaker having a capacity of 1 liter. The aluminum flake was "ALUMINUM PASTE 7675NS" made by TOYO ALUMINIUM Co., Ltd., and it had an average particle diameter $D_{50}$ of 14 micrometers, a specific surface area of 5.3 $m^2/g$ and 65% by weight nonvolatile components. 8 grams of a polybutene resin and 40 grams of a solvent were added to the beaker. The polybutene resin was "POLYBUTENE OH" made by IDEMITSU SEKIYU KAGAKU Co., Ltd., and the solvent was "IP SOLVENT 1620" made by IDEMITSU SEKIYU KAGAKU Co., Ltd. The resulting mixture was stirred at a rate of, 1,000 rpm, thereby dispersing the aluminum powder in the resin and the solvent. Thereafter, 8 grams of another polybutene and 52 grams of another solvent were further added to the beaker while stirring at a rate of 1,000 rpm for 1 hour, thereby producing a nitriding agent. The other polybutene resin was "POLYBUTENE 300H" made by IDEMITSU SEKIYU KAGAKU Co., Ltd., and the other solvent was "BDG" (i.e., polydiglcol) made by NIPPON NYUKAZAI Co., Ltd.

Whilst an aluminum product to be nitrided was prepared, an aluminum alloy according to JIS 5052 was employed and was processed into a plate having a thickness of 1.5 mm. On the aluminum product, the paste-like nitriding agent was coated.

The thus coated aluminum product was placed in a heat treatment furnace, and it was subjected to a nitriding treatment at 580° C. for 5 hours under the following conditions: A pure nitrogen gas containing 99.9% $N_2$ was introduced into the furnace at a flow of 30 liters/min., and a dew point was held in a range of from −40° to −25° C. in the furnace.

There was produced a nitriding layer on the surface of the aluminum products. The nitriding layer had a depth of about 240 micrometers, and it exhibited a hardness of 580 mHv under a load of 100 g.

Ninth Preferred Embodiment

An aluminum flake was weighed so as to place 60 grams of its metallic components in a beaker having a capacity of 1 liter. The aluminum flake was "ALUMINUM PASTE 7620NS" made by TOYO ALUMINIUM Co., Ltd., and it had an average particle diameter $D_{50}$ of 18 micrometers, s specific surface area of 3.3 $m^2/g$ and 65% by weight nonvolatile components. 8 grams of a polybutene resin and 40 grams of a solvent were added to the beaker. The polybutene resin was "POLYBUTENE OH" made by IDEMITSU SEKIYU KAGAKU Co., Ltd., and the solvent was "IP SOLVENT 1620" made by IDEMITSU SEKIYU KAGAKU Co., Ltd. The resulting mixture was stirred at a rate of 1,000 rpm, thereby dispersing the aluminum powder in the resin and the solvent. Thereafter, 8 grams of another polybutene and 52 grams of another solvent were further added to the beaker while stirring at a rate of 1,000 rpm for 1 hour, thereby producing a paste-like nitriding agent. The other polybutene resin was "POLYBUTENE 300OH" made by IDEMITSU SEKIYU KAGAKU Co., Ltd., and the other solvent was "BDG" ( i.e., polydiglcol) made by NIPPON NYUKAZAI Co., Ltd.

Whilst an aluminum product to be nitrided was prepared, an aluminum alloy according to JIS 5052 was employed and was processed into a plate having a thickness of 1.5 mm. On the aluminum product, the paste-like nitriding agent was coated.

The thus coated aluminum product was placed in a heat treatment furnace, and it was subjected to a nitriding treatment at 580° C. for 5 hours under the following conditions: A pure nitrogen gas containing 99.9% $N_2$ was introduced into the furnace at a flow of 30 liters/min., and a dew point was held in a range of from –40° to –25° C. in the furnace.

There was produced a nitriding layer on the surface of the aluminum products. The nitriding layer had a depth of about 220 micrometers, and it exhibited a hardness of 540 mHv under a load of 100 g.

Tenth Preferred Embodiment

An aluminum flake was weighed so as to place 60 grams of its metallic components in a beaker having a capacity of 1 liter. The aluminum flake was "ALUMINUM PASTE 46-046" made by TOYO ALUMINIUM Co., Ltd., and it had an average particle diameter $D_{50}$ of 37 micrometers, a specific surface area of 2.4 $m^2/g$ and 65% by weight nonvolatile components. 8 grams of a polybutene resin and 40 grams of a solvent were added to the beaker. The polybutene resin was "POLYBUTENE OH" made by IDEMITSU SEKIYU KAGAKU Co., Ltd., and the solvent was "IP SOLVENT 1620" made by IDEMITSU SEKIYU KAGAKU Co., Ltd. The resulting mixture was stirred at a rate of 1,000 rpm, thereby dispersing the aluminum powder in the resin and the solvent. Thereafter, 8 grams of another polybutene and 52 grams of another solvent were further added to the beaker while stirring at a rate of 1,000 rpm for 1 hour, thereby producing a paste-like nitriding agent. The other polybutene resin was "POLYBUTENE 300H" made by IDEMITSU SEKIYU KAGAKU Co., Ltd., and the other solvent was "BDG" (i.e., polydiglcol) made by NIPPON NYUKAZAI Co., Ltd.

Whilst an aluminum product to be nitrided was prepared, an aluminum alloy according to JIB 5052 was employed and was processed into a plate having a thickness of 1.5 mm. On the aluminum product, the paste-like nitriding agent was coated.

The thus coated aluminum product was placed in a heat treatment furnace, and it was subjected to a nitriding treatment at 580° C. for 5 hours under the following conditions: A pure nitrogen gas containing 99.9% $N_2$ was introduced into the furnace at a flow of 30 liters/min., and a dew point was held in a range of from –40° to –25° C. in the furnace.

There was produced a nitriding layer on the surface of the aluminum products. The nitriding layer had a depth of about 100 micrometers, and it exhibited a hardness of 680 mHv under a load of 100 g.

Eleventh Preferred Embodiment 130 grams of an atomized aluminum powder was weighed in a beaker having a capacity of 1 liter. The atomized aluminum powder was "AC5000" made by TOYO ALUMINIUM Co., Ltd., and it had an average particle diameter $D_{50}$ of 9 micrometers and a specific surface area of 0.8 $m^2/g$. Then, 20 grams of a polybutene resin and 30 grams of a solvent were added to the beaker. The polybutene resin was "POLYBUTENE OH" made by IDEMITSU SEKIYU KAGAKU Co., Ltd., and the solvent was "IP SOLVENT 1620" made by IDEMITSU SEKIYU KAGAKU Co., Ltd. The resulting mixture was stirred at a rate of 1,000 rpm, thereby dispersing the aluminum powder in the resin and the solvent. Thereafter, 20 grams of another polybutene was further added to the beaker gradually while stirring at a rate of 3,000 rpm for 1 hour, thereby producing a nitriding agent. The other polybutene resin was "POLYBUTENE 300H" made by IDEMITSU SEKIYU KAGAKU Co., Ltd.

Whilst an aluminum product to be nitrided was prepared, a pure aluminum according to JIS 1101 was employed and was processed into a plate having a thickness of 1.0 mm. On the aluminum product, the paste-like nitriding agent was coated.

The thus coated aluminum product was nitrided in the same manner as described in the "Sixth Preferred Embodiment" section. As a result, there was produced a nitriding layer on the surface of the aluminum product. The nitriding layer had a depth of about 70 micrometers, and it exhibited a hardness of 750 mHv under a load of 100 g.

Having now fully described the present invention, it will be apparent to one of ordinary skill in the art that many changes and modifications can be made thereto without departing from the spirit or scope of the present invention as set forth herein including the appended claims.

What is claimed is:

1. A process for producing a case nitrided aluminum product, comprising the steps of:

contacting an aluminum substrate with a nitriding agent at a surface portion thereof, the nitriding agent comprising an aluminum powder; and nitriding the surface of the aluminum substrate with an ambient gas at a temperature below the melting point of the aluminum substrate while maintaining contact between said aluminum substrate with said nitriding agent, the ambient gas comprising a nitrogen gas.

2. The process for producing a case nitrided aluminum product according to claim 1, wherein said aluminum product comprises magnesium in an amount of 0.5% by weight or more.

3. The process for producing a case nitrided aluminum product according to claim 1, wherein said contacting step comprises burying said aluminum substrate in said nitriding agent only at a surface portion thereof to be nitrided.

4. The process for producing a case nitrided aluminum product according to claim 1, wherein said nitriding agent is a paste consisting of said aluminum powder and a viscosifying agent.

5. The process for producing a case nitrided aluminum product according to claim 1, wherein said aluminum powder comprises magnesium in an amount of 0.5% by weight or more.

6. The process for producing a case nitrided aluminum product according to claim 1, wherein said aluminum powder comprises an aluminum powder which is quenched and solidified at a cooling rate of $10^{2c}$ C./sec. or more.

* * * * *

UNITED STATES PATENT AND TRADEMARK OFFICE

CERTIFICATE OF CORRECTION

PATENT NO. : 5,514,225

DATED : May 7, 1996

INVENTOR(S) : Yasuhiro Yamada, Hirohisa Miura, Mamoru Okamoto, Takashi Matsufuji, Taro Tatsumi and Kazuo Fuji It is certified that error appears in the above-indentified patent and that said Letters Patent is hereby corrected as shown below:

[73] Assignees: Please change "Toyo Aluminum K.K." to --Toyo Aluminium K.K.--.

Signed and Sealed this

Eleventh Day of March, 1997

*Attest:*

*Attesting Officer*

BRUCE LEHMAN

*Commissioner of Patents and Trademarks*